United States Patent [19]

Thacker

[11] Patent Number: 4,977,808

[45] Date of Patent: Dec. 18, 1990

[54] STRINGED MUSICAL INSTRUMENT WITH A SOLID BODY MADE OF CLAY BASED MATERIAL

[76] Inventor: Robin Thacker, 1604 Poplar Rd., Mascouche Heights, Quebec, Canada, J7L 2J3

[21] Appl. No.: 315,563

[22] Filed: Feb. 27, 1989

[51] Int. Cl.[5] ..... G10D 3/00

[52] U.S. Cl. ..... 84/291; 84/452 R

[58] Field of Search ..... 84/291, 452 R

[56] References Cited

U.S. PATENT DOCUMENTS 518,900 4/1894 Seal ..... 84/291
3,769,871 11/1973 Cawthorn ..... 84/291
4,031,798 6/1977 Sider ..... 84/291
4,308,784 1/1982 Eizonas ..... 84/452 R

OTHER PUBLICATIONS

Rene Clemenicic, "Old Musical Instruments", Octopus Books, London, 1973, pp. 60–63.

*Primary Examiner*—Lawrence R. Franklin
*Attorney, Agent, or Firm*—Larson and Taylor

[57] ABSTRACT

A stringed musical instrument, such as an electric guitar, having a solid body made of clay-based material. The body is made by shaping a greenware from a clay-based material, and firing the greenware to cause it to permanently harden. The body is then glazed to obtain a smooth, non-porous finish.

6 Claims, 3 Drawing Sheets

STRINGED MUSICAL INSTRUMENT WITH A SOLID BODY MADE OF CLAY BASED MATERIAL

FIELD OF THE INVENTION

The invention relates to the art of manufacturing musical instruments and, more particularly, to a stringed musical instrument having a solid body made of clay-based material.

BACKGROUND OF THE INVENTION

Solid body stringed musical instruments such as electric guitars, among others, are conventionally manufactured by sculpting a body from suitable wooden material, to which are subsequently mounted a neck, electronic hardware and strings. The process is completed by subjecting the guitar to conventional finishing steps such as painting and polishing for the purpose of improving the aesthetical appearance of the instrument.

The above manufacturing technique has numerous drawbacks. For example, it is very difficult to obtain, into a single production run, two guitars that have identical sound characteristics because the grain orientation of the wood is different from one guitar body to another, thus resulting in instruments that resonate slightly differently. In addition, the wood sculpting operation for making the body of the instrument is an expensive and a time-consuming step.

OBJECTS AND STATEMENT OF THE INVENTION

An object of the present invention is a solid body stringed musical instrument with improved sound characteristics.

Another object of the invention is an improved process for manufacturing solid body stringed musical instruments.

I have discovered that the above objects may be achieved by using ceramic material for the construction of the instrument body instead of other commonly used materials. The ceramic material improves the tonal quality of the sound, improves the resonating quality of the sound and also improves the sustained duration of the particular stringed instrument. This is mainly due to the high density of ceramics over wood.

The shaping and forming of such a ceramic body is much more easily and inexpensively done than conventional wood sculpting methods. Ceramics may be molded, pressed, shaped, etc., inexpensively, and repeated near perfect bodies can be fabricated by the use of molds. Furthermore, due to the better homogeneity of ceramics over wood, musical instruments with almost identical sound characteristics may be easily mass produced.

In addition to the above, a ceramic body may be provided with a durable and aesthetic glazed surface which is longer lasting than paints and varnishes employed with conventional wooden bodies.

In a preferred embodiment, the guitar body is manufactured by pouring into a shaping mold, clay slip. The clay slip remains in the mold for a predetermined time to sufficiently dry allowing the clay body to be handled. When this preliminary drying period is completed, the mold is opened and the greenware (unfired clay) is removed and trimmed down if necessary. The greenware piece is then provided with recesses at predetermined locations, used for receiving fasteners to attach the other components of the guitar to the body. When this operation is completed, the greenware is fired into a kiln so that the clay permanently crystallizes. If desired, the fired guitar body is then coated with glazing material and fired again to obtain a hard, non-porous shiny finish.

The manufacturing process is completed by mounting to the finished body, the remaining components of the guitar, namely the neck, the electronic hardware, the strings, etc. More specifically, this is achieved by inserting into the fastener receiving recesses of the body, dowel pins of wood or plastic material intended for receiving screws or similar fasteners.

In broad terms, the present invention may therefore be defined as a solid body for a stringed musical instrument made of clay based material.

The invention also extends to a manufacturing process for such a solid body, comprising the general steps of:

(a) shaping said solid body from clay based material; and (b) firing the clay body to harden same.

The invention also extends to musical instruments employing the solid body in accordance with the invention, as well as to manufacturing processes and techniques of such musical instruments.

Herein, the term "solid body" is intended to exclude thin walled hollow bodies, typically used in the construction of acoustic guitars, violins, cellos or the like, in which the thin walled hollow body is used for sound amplifying purposes. On the contrary, thick walled solid bodies exhibit little or no sound amplification characteristics, this task being performed by electronic pick-ups and amplifiers.

Herein, the term "clay" is intended to encompass natural compositions as well as synthetically done blends.

DESCRIPTION OF A PREFERRED EMBODIMENT

Figure 2:
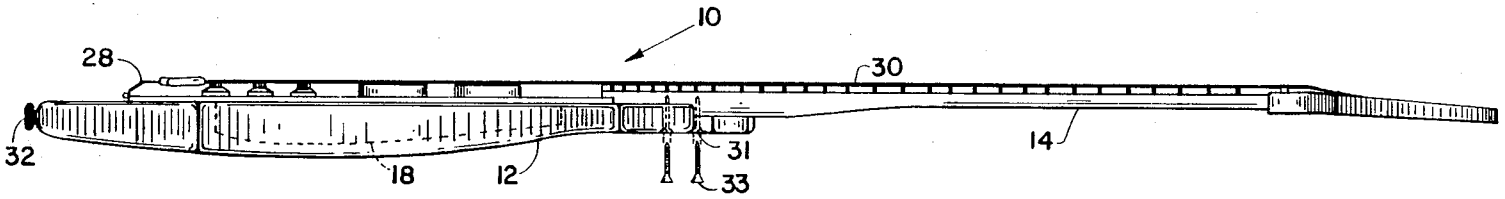
FIG. 2 is a side view of the guitar shown in FIG. 1.
Figure 2A:
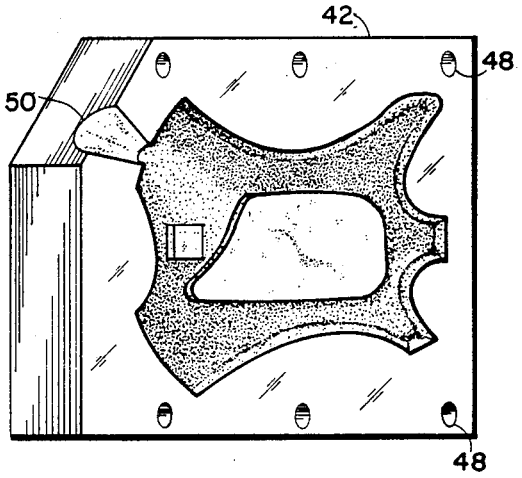
FIGS. 2*a* and 2*b* are perspective views of the left and the right mold halves respectively, for shaping a guitar body.
Figure 2B:
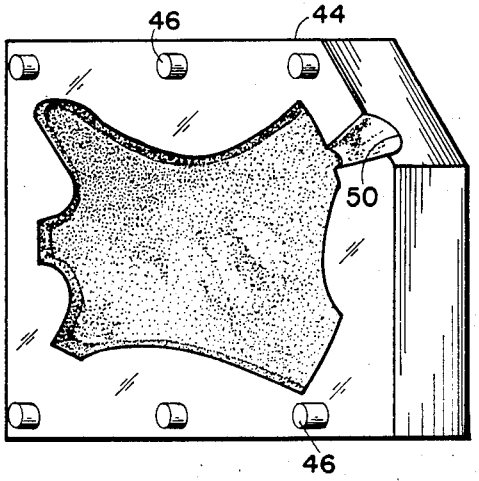

Referring now to the annexed drawings, the reference numeral 10 designates in general, an electric guitar constructed in accordance with the present invention. The guitar 10 comprises a ceramic body 12 carrying a conventional neck assembly 14 attached at one end to the body 12, and being provided at the opposite end with tuning pegs 16 as it is customary in the art. The body 12 is provided with a centrally located hollow region 18, best illustrated in FIG. 2, for housing the electronic hardware of the guitar such as pick-ups 20 to generate an electronic signal upon oscillation of strings, and volume and tone control potentiometers (not shown in the drawings).

The hollow region 18 is closed by a pick-guard, typically made of plastic material and secured to the body 12 by means of small screws 22. Through the pick-guard extend the pick-ups 20 and control knobs 24 for the volume and tone control potentiometers. Also, the pick-guard 19 serves as a support for a jack assembly 26 used for connecting the guitar to an amplifier.

A tremolo bridge assembly 28 is mounted to the body 12 and together, in conjunction with the tuning pegs 16, constitute a support for the guitar strings 30.

Figure 1:
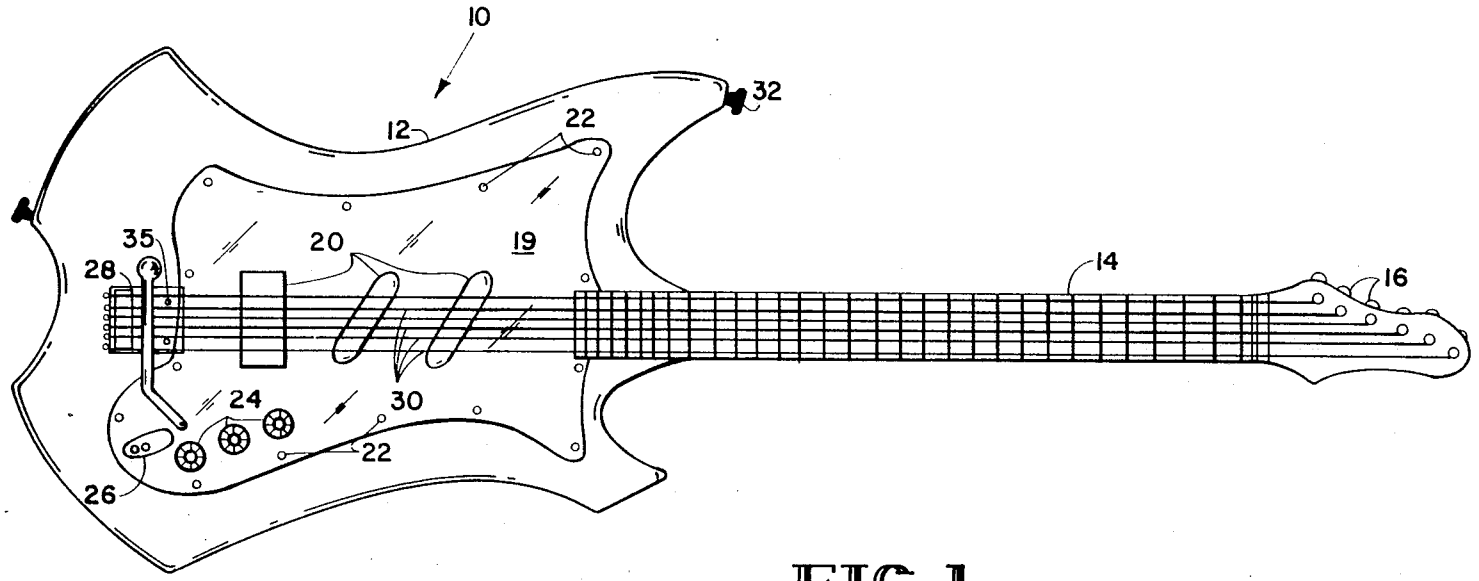
FIG. 1 is an elevational view of a solid body electric guitar, in accordance with the present invention.

The neck assembly 14 and the tremolo assembly 28 are mounted to the guitar body 12 by means of screw type fasteners. More particularly, referring to FIG. 2, the body 12 is provided with two openings 31, extending completely through the body 12, for receiving long wood screws 33 with threaded ends engaged in the neck of the guitar. The tremolo bridge assembly 28 is also mounted with wood screws to the body 12, indicated at 35 in FIG. 1, engaging dowel pins (not shown) received into specially provided recesses in the ceramic material of the body 12.

The guitar 10 also comprises two conventional strap clips 32. The clips 32 are secured to the guitar body 12 in much the same way as the tremolo bridge assembly 28, namely by wood screws engaging dowel pins (not shown).

The process for manufacturing the guitar 12 comprises generally the steps of shaping the body from a clay based material and firing the body so that it hardens and assumes a permanent form. Then, if desired, the body may be glazed to obtain the desired finish.

The following is a non-exhaustive list of well known techniques for shaping clay based material:

(a) dust press
(b) stiff mud
(c) hot pressing
(d) soft mud molding
(e) hand building
(f) slip casting
(g) pressure casting
(h) vacuum casting
(i) hygroscopic casting
(j) hygroscopic pressing.

Among the existing clay shaping techniques, the slip casting method is preferred because it is the least expensive. This process consists of providing a porous shaping mold, of the type illustrated in FIGS. 2 and 3, and designated by the reference numeral 40. The mold 40, which may be made of metal or plaster, comprises two halves 42 and 44 respectively, that mate to form an internal cavity having a shape corresponding to the shape of the body 12. To insure proper alignment of the mold halves when they are closed, the mold half 44 is provided with alignment keys 46 that fit into respective openings 48 on the mold half 42.

Figure 3:
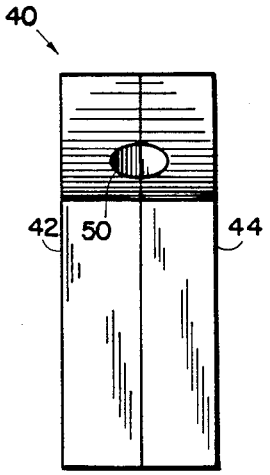
FIG. 3 is a side view of the shaping mold in closed position.
Figure 4:
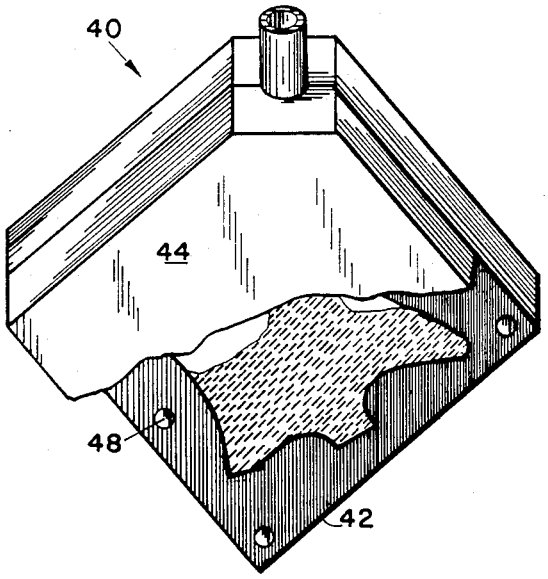
FIG. 4 is a schematical view illustrating the mold as being filled with clay slip.

When the mold 40 is closed, as shown in FIG. 3, an opening 50 communicating with the internal cavity of the mold is defined, allowing to fill the internal cavity with slip which basically is clay in fluid state obtained by diluting the clay with water or any other suitable diluting agent.

Figure 5:
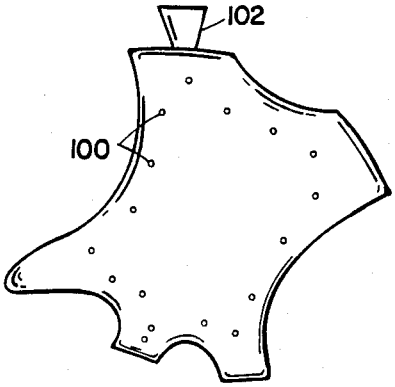
FIG. 5 is an elevational view of the clay body in a semi-dried state removed from the mold.

When the mold 40 is completely filled with clay slip, it remains closed for a certain period of time, so that the clay slip can partially dry thus allowing the shaped clay body to be handled for further processing. The clay in semi-dried state, the so-called greenware, is demolded, the spare 102 is removed and the greenware is allowed to dry thoroughly. At the end of this second drying period, recesses are provided in the greenware at predetermined locations, which are to receive fasteners used for retaining the other components of the guitar to the body. These recesses may be performed simply by insertion of a tip of a predetermined size, at predetermined locations, in the greenware. Evidently, it may be envisaged to use an automatic machine for providing the recesses at the predetermined locations, which is well suited for a highly automated production. The fastener receiving recesses are schematically shown at 100 in FIG. 5.

Figure 6:
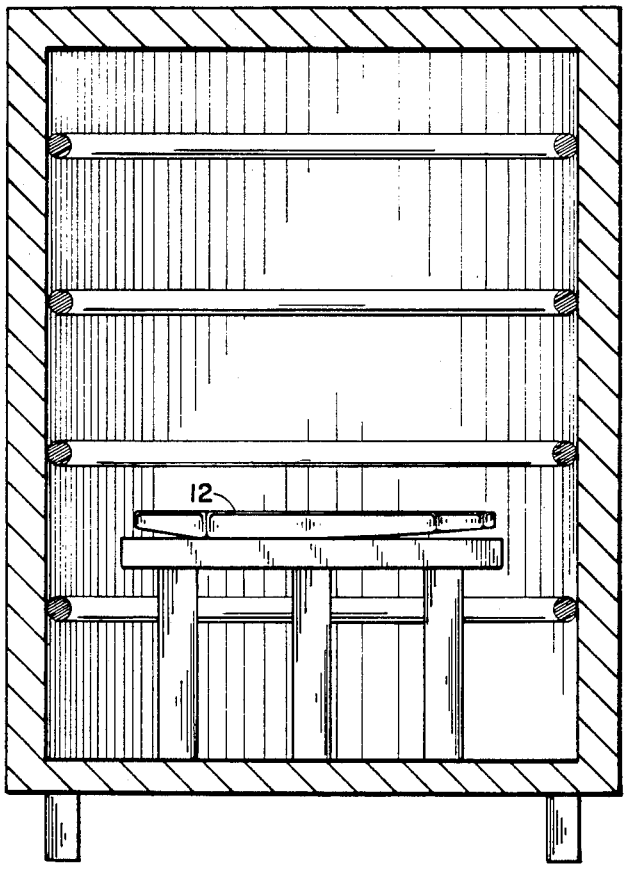
FIG. 6 is a schematic view of the clay body as being fired into a kiln.

The greenware is then placed into a kiln to be fired so as to crystallize the clay into a permanently shaped body. FIG. 6 schematically illustrates an electric kiln which basically is a fire-proof and a temperature resistant enclosure with electric heating elements with a support for mounting the piece to be fired. The temperature as well as the duration of this thermal treatment depend upon the type of clay used.

It should be appreciated that during the firing operation, the guitar body 12 shrinks by an appreciable amount, therefore, the fastener receiving recesses somehow shift position. For a precise fit of the other components of the guitar, the position of the fastener receiving recesses in the greenware should be calculated to allow for the shrinkage at the firing stage.

If it is desired to locate very precisely the fastener receiving recesses 100 on the body 12, the recesses 100 may be formed after the firing operation with a suitable ceramic drilling machine. However, this method is expected to increase somewhat the manufacturing costs due to the expensive tooling required.

When the firing stage is completed, the guitar body is subjected to a glazing operation which consists of applying on the fired guitar body, a suitable glazing product such as by brushing or spraying and to fire the body again to cure the glazing product.

Glazing products allowing to provide various types of finishes are commercially available. It is within the present art to select the proper glazing product as well as the conditions for applying and curing same on the guitar body.

When the glazing operation is completed, dowel pins (not shown) of wood or plastic material are inserted in the fastener receiving recesses 100 on the guitar body 12. The remaining components of the guitar such as the neck, the tremolo assembly, the electronic components, etc., are then assembled by using screws which engage the dowel pins.

The specific formula for the ceramic material used in the construction of the guitar body may vary within wide limits. It is within the present art to select the proper composition in accordance with the desired characteristics such as weight, strength and resonance, among others. In addition, technicalities such as the drying time of the clay, the firing temperature and duration, are well known to those skilled in the art and it is not deemed necessary here to explore the various possibilities.

The ceramic material used for the construction of the body 12, may be provided with reinforcing fibers and/or fillers to obtain specific characteristics such as high resistance and a relatively low weight. The type of fibers and/or fillers to be used as well as their specific ratio in the ceramic material are known to those skilled in the art.

The musical instrument body, in accordance with the invention, has numerous advantages over conventional wooden bodies, namely improved sound characteristics, better homogeneity in addition to being inexpensive to manufacture. The use of clay based material for the construction of the body further allows to fine tune the resonance characteristics thereof by properly selecting the composition of the clay.

Since the clay composition can vary widely, a much larger tuning range results, by comparison to wooden bodies, which offer a much more restricted tuning freedom.

The above description of a preferred embodiment of this invention should not be considered in any limiting manner since it is given only as an example that can be modified and refined in various ways without departing from the spirit of the invention.

I claim:

1. A stringed musical instrument comprising:

a solid resonating body made of dense and homogeneous ceramic material obtained from a clay-based fluid slip;

an elongated neck assembly mounted to said body;

strings mounted to said neck assembly and extending therealong; and pick-up means mounted to said solid body for sensing oscillation of said strings and for generating an output signal upon oscillation of at least one of said strings.

2. A musical instrument as defined in claim 1, wherein said clay-based slip includes fibers.

3. A musical instrument as defined in claim 1, wherein said clay-based slip comprises a filler.

4. A musical instrument as defined in claim 1, wherein said solid body comprises a plurality of recesses for receiving a fastener holding medium.

5. A musical instrument as defined in claim 1, wherein said fastener holding medium is selected in the group consisting of wood and plastic material.

6. A musical instrument as recited in claim 1, wherein said solid body comprises a hollow region for housing said pick-up means.

* * * * *